US005549140A

United States Patent [19]

Lindblom

[11] Patent Number: 5,549,140

[45] Date of Patent: Aug. 27, 1996

[54] BACK REST ARRANGEMENT FOR CONTROLLING WARP THREAD TENSION

[75] Inventor: Bo Lindblom, Almhult, Sweden

[73] Assignee: Texo AB, Almhult, Sweden

[21] Appl. No.: 351,233

[22] PCT Filed: Jun. 4, 1993

[86] PCT No.: PCT/SE93/00498

§ 371 Date: Dec. 5, 1994

§ 102(e) Date: Dec. 5, 1994

[87] PCT Pub. No.: WO93/25743

PCT Pub. Date: Dec. 23, 1993

[30] Foreign Application Priority Data

Jun. 10, 1992 [SE] Sweden ..... 9201780

[51] Int. Cl.[6] ..... D03D 49/04

[52] U.S. Cl. ..... 139/114

[58] Field of Search ..... 139/114, 115

[56] References Cited

U.S. PATENT DOCUMENTS

| | | | |
|---|---|---|---|
| 3,526,252 | 9/1970 | Hindle | 139/114 X |
| 4,240,471 | 12/1980 | Rotrekl et al. . | |
| 4,619,294 | 10/1986 | Sainen et al. . | |
| 4,817,677 | 4/1989 | Deconinck et al. . | |
| 5,090,452 | 2/1992 | Benelli | 139/115 X |

FOREIGN PATENT DOCUMENTS

| | | | |
|---|---|---|---|
| 0208366 | 1/1987 | European Pat. Off. . | |
| 0456274 | 11/1991 | European Pat. Off. | 139/114 |
| 2520012 | 7/1983 | France . | |
| 2639366 | 5/1990 | France | 139/114 |
| 629549 | 12/1978 | Switzerland . | |

*Primary Examiner*—Andy Falik

*Attorney, Agent, or Firm*—Pollock, Vande Sande & Priddy

[57] ABSTRACT

A device controls warp thread tension in a weaving machine, which the warp thread tension being dependent upon rotation of a plurality of beams forming part of the weaving machine and included in a back rest system for the warp threads, wherein the plurality of beams are pressed against each other and the warp threads run between the beams. At least one beam of the plurality of beams is suspended in a positionally mobile manner and at least one force detection mechanism is provided for detecting at least one force resulting from the wrap thread tension exerted on the beam and for generating at least one control signal. The at least one control signal controls an activation system for providing the thread tension control by affecting the rotations of the beams in both their rotational directions adjusting the feed of the warp threads continuously or by close-intervalled step-by-step changes in forward and backwards directions.

11 Claims, 2 Drawing Sheets

BACK REST ARRANGEMENT FOR CONTROLLING WARP THREAD TENSION

TECHNICAL FIELD

The present invention relates to a device for controlling, preferable continously or at close intervals during ongoing weaving, thread tension in a weaving machine, which thread is dependent upon position and/or rotation of one or more beams forming part of the weaving machine.

The invention is applicable to weaving dobbies of various types for example dobbies for forming weaving, blanket weaving, and the like, and dobbies which operate with open and closed sheds, and the like. The invention can advantageously be used on weaving machines which operate with large fabric widths, e.g. 10–30 meter fabric widths.

BACKGROUND OF THE INVENTION

It is known to propose different types of control of the warp thread tension in a weaving machine. By influencing the speeds of the beam or beam concerned, it is possible, where there are tendencies for the warp threads to slacken, to obtain a tendering effect in the thread during certain stages of the weaving.

It is also known to arrange the beam in a spring-mounted disposition, so that a certain positional mobility is obtained in each beam.

It is also known to control weaving machine function by means of computer equipment, which can in this case operate with conventional software for the control system/control in question.

There is a requirement to produce high-quality woven products using rational production processes. Weaving machine manufacturers are faced with high demands regarding the function of weaving machine, which must be performed with a high degree of reliability and must enable simpler operating and handling procedures for staff working at the machines, faster weaving speeds, long working life for the weaving machine, long service intervals, and the like. Added to this is the fact that price pressure upon product development, manufacturing, and the like for the actual machine construction, is being accentuated to a still greater degree. The weaving machine has to work with few operating breakdowns and stoppages.

SUMMARY OF THE INVENTION

The above means, among other things, that recourse must be taken to a refined control function for functional parts included within the weaving machine. The thread arrangement in the weaving machine represents a swinging mass which must be optimally controlled so that weaving machine functions which follow one another in the course of the weaving can be performed in an unbroken and effective sequence. By providing the adaptive beam arrangement the rotations and/or positions of the booms are altered during ongoing weaving, and the thread tension in the warp threads can be kept within predetermined, desired thread tension ranges or essentially constant. The object of the present invention is to propose an arrangement which solves, this problem.

Furthermore there is a requirement to weave with a higher and more uniform quality. The individual thread tensions in the warp threads must be adapted to the binding and/or wrapping pattern between the warp and weft threads, so that the weft function remains essentially the same, irrespective of the pattern. This problem is also solved by the present invention. The adaptiveness of the rotation and/or position of each beam should also be adjusted to different thread material qualities, production variances in the machine, and the like. The invention aims to also solve this problem.

According to the present invention, precise feedback function(s) should be arranged for each beam control. The beams in question should also be controlled with great accuracy, despite a relatively large mass in the beam. The present invention aims to solve this problem as well.

Wear and changes in the internal and external conditions in the weaving machine and in the thread material can also continuously occur. Compensations in the control of the beams and other components in the machines must therefore be continuously carried out. The present invention aims also to solve this problem.

According to the invention, for the control of each beam or for the control of the beams, use should be made of AC-servo motors of a known type, or of cylinders operating with a feedback function (for example hydraulic cylinders), and the like. The control mechanisms should be incorporated into an expedient function containing the above-specified requirements for the weaving machine, the woven product, and the like. The present invention aims to solve this problem as well.

One object of the invention is also to achieve an effectively operating back rest arrangement in which one or more beams are arranged to be positionally mobile or displaceable in the space. A back rest arrangement of this kind should be able to work together, in the thread tension control, with other components in the weaving machine which have an influence on the same. A coordination problem exists in this context between the various functions in the weaving machine which exert an influence upon the thread tension control. The beam arrangement and its control system must in this case be constructed so that there is adjustment to the construction and control systems of the other components in the weaving machine. The present invention aims to solve this problem also.

The invention can be used in dobbies in which shaft frames are included for the creation of open and closed sheds during the continuous weaving in the machine. The shaft frames have an influence upon the thread tension and the arrangement with back rest(s) and the control system has to be coordinated with the control systems and functions of the shaft frames. The invention aims to solve this problem also.

The features of a device according to the invention is, among other things, that at least one beam of the beams is suspended in a positionally mobile manner and is arranged to be detectable by a force detection mechanism, preferably having the form of a lead cell, which force detection mechanism generates one or more electrical signals. The value(s) and/or number of the signal(s) is dependent upon one or more forces, exerted by the thread tension, upon the beam(s). The signal or signals in this context form(s) part, as control signal(s), of an activation system, exercising the thread tension control, for the position(s) and/or rotation(s) of the beam(s). The activation system will in this case comprise a drive source which operates with a feedback function and which preferably has the form of or includes an alternating-current servo motor, here referred to as an AC-servo.

In one embodiment of the inventive concept, the beam or beams form(s) part of a back rest system for warp threads in a weaving machine. The beam(s) can be driven by the alternating-current servo motor via a gearbox system. Each force detection mechanism/lead cell can be arranged at that one of the beams from which the warp thread runs out. The activation system includes, in one embodiment, a computer unit which receives and processes the control signal(s). The computer unit, in dependence upon the reception and processing, generates one or more target-value signals to the alternating-current servo motor, which, for the execution of its feedback function, also includes a transmitter mechanism, which is preferably constituted by a pulse transmitter, the signal (actual-value signal) of which can be fed back to the computer unit. The computer unit generates the target-value signal(s) with the aid of this feedback signal (actual value signal(s)). The force detection mechanism or lead cell produces an electric signal which is proportional to the detected force exerted on the beam resulting from the thread tension.

Each beam is suspended in a positionally mobile manner in two or more mounting points along its respective longitudinal extents. A force detection mechanism or lead cell is arranged in one or more of the mounting points.

In the event of a plurality of interacting beams, for example beams which form part of a back rest system, the activation system effectuates the thread tension control by means of a continuous or close-intervalled, step-by-step change in the rotation(s)/rotational speed(s) of the beam(s). The activation system can also take account of the fact that thread advancement in a feed-out direction has to take place during ongoing weaving. Each force detection mechanism bears against each beam via a power transmission mechanism which transmits the force from the rotating beam to the power cell which is fixedly arranged relative to the beam.

The activation system can also operate with a positional movement and/or rotation of each beam, which motion is guided by the weaving program of the weaving machine. In this case, a comparison can be made of the thread tension control effectuated by the weaving program and the thread tension control actually obtained. Any differences in the predetermined control and the actual control can then be adjusted, so that the weaving machine program is able to operate with altered/adjusted/adaptive values. The thread tension control is effectuated on a thread system formed by warp and weft threads, in which system the total fabric width can assume values of up to 10–30 meters and in which the weaving speed can be up to about 100 picks per minute. The thread tensions in the warp threads can be up to about 50,000 Newton/meter.

Each beam can be activated, by means of force effectuated by the warp threads, against the action of a spring which endeavours to return the beam to its position. The beam system can also be arranged so that it is positionally variable in its entirety, together with the force detection mechanism(s), which is/are fixedly arranged relative to the beam(s).

As a result of that which is proposed above, an effective control of the thread tension function in a weaving machine can be obtained. For the implementation of the invention, use can be made in the weaving machine of known components for the AC-servo, computer unit, software, and the like. Also the back rests as such, as well as the gearbox, can be constructed in a known manner. The thread tension control exercised by the present invention can be coordinated with other components in the weaving machine system which act upon the thread tension for the achievement of an, effectively operating thread tension control function. High and uniform quality can be obtained in the woven material, blanket, fabric, and the like.

BRIEF DESCRIPTION OF THE DRAWINGS

A presently proposed embodiment of a device exhibiting the characteristics which are indicative of the invention will be described below, with simultaneous reference to the appended drawings, in which.

DETAILED DESCRIPTION OF THE PREFERRED EMBODIMENTS

Figure 1:
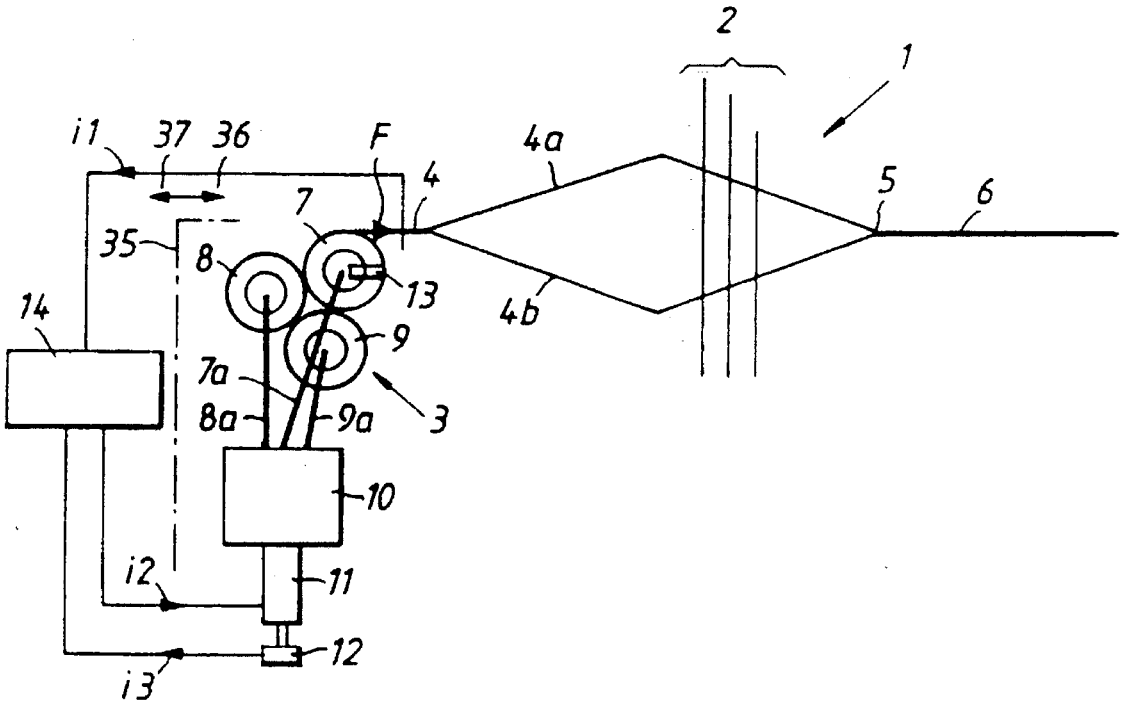
FIG. 1 shows, in a basic diagram form, parts, which are affected by the invention, in a weaving machine which, in the present instance, is constituted by a dobby.

FIG. 1 shows relevant parts of a dobby 1, which is symbolized by a generally indicated shaft frame system 2 and a back rest system 3. The warp threads running out from the back rest system are indicated by 4. The warp threads are divided into a shed by the shaft frame and, in the arrangement shown in FIG. 1, the threads for the upper shed have been indicated by 4*a* and for the lower shed by 4*b*. The butting edge is defined by 5 and the fabric which has been finish-woven in the weaving machine has been designed by 6. The back rest arrangement is represented, in this embodiment, by three back rest beams 7, 8 and 9. The beams are driven by a gearbox system 10, which acts upon the beams 7, 8 and 9 individually via power transmission systems 7*a*, 8*a* or 9*a*. Gearbox and power transmission systems of this kind are already well known and will not be described here in any greater detail.

The gearbox system 10 is driven by an AC-servo, which can be of the SEIDEL type. An AC-servo of this kind is provided on its axle with a pulse transmitter 12, which indicates or detects rotated turns of the AC-servo. The beam 7 of the beam arrangement is provided with a force detection mechanism in the form of a load cell 13, which can be constituted by a known model and can be of the NOBEL Elektronik type, for example. The AC-servo thus forms a drive source for the beams 7, 8 and 9 via the gearbox system 10. The drive source 11 operates with a feedback function of which the pulse transmitter 12 forms a part. The beam 7 is spring-mounted and the load cell 13 detects the force F brought about or generated by the warp threads 4 and emits, in dependence upon the detection, an electrical signal il which is dependent on the force F. A computer unit 14, of a known type, forms part of an activation system for the AC-servo. The computer unit 14 receives, as a control signal, the signal i1 from the load cell 13. The computer unit processes the received signal i1 and delivers a target-value signal i2 to the AC-servo 11. The signal of the pulse transmitter is utilized as an actual-value signal i3. In the present instance, the force F is controlled with the aid of rotational changes (speed and/or direction) in the beams 7, 8 and 9, brought about by the AC-servo via the gearbox 10. The computer unit 14 detects the force via the load cell and primes the AC-servo so that the rotational changes or changes in rotational speeds materialize. The system thus operates with an outer, open loop and an inner, closed loop, in which the return signal i3 is fed back to the computer. The computer unit, in its control of the AC-servo, therefore makes use of both the signals i1 and i3 for generating the signals i2.

Figure 2:
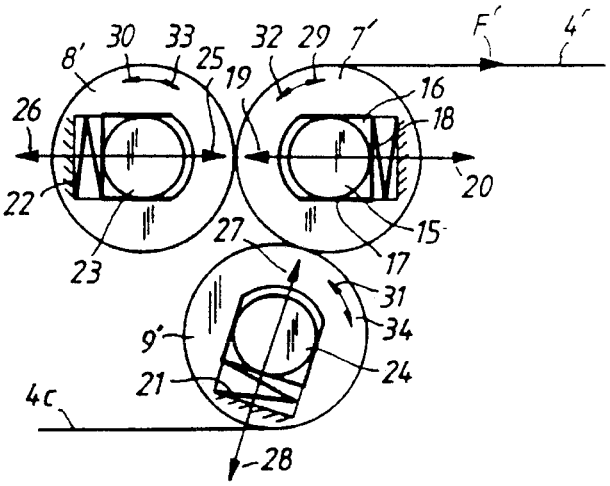
FIG. 2 shows, in an end view, mounting points for beams in a back rest system.

In FIG. 2, the beams are indicated by 7', 8' and 9'. The beam 7' is essentially spring-mounted in a number of mounting points and a mounting point of this kind is shown in FIG. 2. The beam 7' is arranged having a tapered axle part 15, which is displaceably mounted in a mounting space 16. The mounting bracket is not shown in detail since its principle and construction are assumed to be already known. The mounting bracket is symbolized by 17. In the mounting space there is arranged a spring 18, which guides the beam 7' in the direction of the arrow 19. The above-stated force has here been denoted by F', which force activates the beam 7' in the direction of the arrow 20 against the action of the spring 18. The directions 19 and 20 essentially coincide with the direction of the outgoing warp thread 4'. The warp threads run in towards the beam 9' and the warp thread parts in question have been denoted by 4c. The warp threads run around the beam 9' and between the beams 7' and 9', in order to continue around the beam 7' and between the beams 7' and 8'. In accordance with the above, the warp 4' runs out from the beam 7'. The beams 8' and 9' are also essentially spring-mounted, so that they are pressed, by means of the springs 21 and 22 respectively, against the beam 7'. The beams 8' and 9' have tapered axle sections 23 and 24 respectively, similarly to the beam 7' (see 15). The beams 8' and 9' are mounted essentially in a corresponding manner to the beam 7' and are able to move towards and away from this beam in the directions of the arrows 25, 26 and 27, 28 respectively. In the illustrative embodiment, it can be noted that the spring 18 is stronger than the spring 22, since it must be able to absorb both the force F' and the force from the spring 22.

The beams 7', 8' and 9' are rotatable in first directions 29, 30 and 31, respectively. The thread tension force F' must be maintained at an essentially constant value or within a predetermined force value range with the aid of change in the rotational speeds of the beams 7', 8' and 9'. The control must in this context take place such that a suitable advancement function occurs in the weaving machine in the back rest system formed by the beams 7', 8' and 9', simultaneously with the maintenance of constancy being able to be effectuated. In one embodiment, the beams 7', 8' and 9' can also be rotated in the other direction 32, 33 and 34. Supplementary or alternatively to this, the entire beam assembly, together with the gearbox and drive source system, can be arranged in a positionally displaceable manner. This positional displaceability has basically been indicated in FIG. 1 by 35, the displacement directions of the assembly having been shown by the arrows 36 and 37. The displaceability of the beamassembly can be achieved in a known manner.

Figure 3:
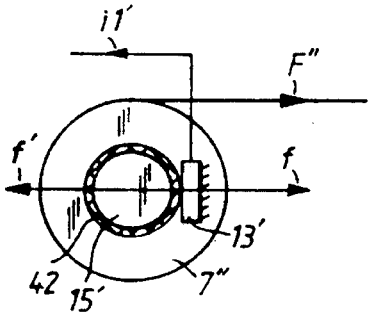
FIG. 3 shows, an end view, of the arrangement of a force detection mechanism in a mounting point for a beam shown in a FIG. 2.

According to the invention, at least one of the beams in the beam system shown is arranged so as to be detectable by means of a force direction mechanism, which has been defined in FIG. 3 by 13' . The beam whose force has been detected has been indicated in FIG. 3 by 7" and corresponds to the beams 7 and 7' in FIGS. 1 and 2, respectively. The force F and F' in FIG. 1 and 2 has been indicated by F" in FIG. 3. The bearing force of the beam 7" against the force detection mechanism 13' is indicated by f and the counterforce from the lead cell 13' by f', which is the same size as the force f, which in turn corresponds to the force F". The lead cell is fixedly arranged relative to the beam 7". In the embodiment having a displaceable beam assembly 35, the lead cell 13' is displaceable with the assembly, but is simultaneously fixed in relation to the beam 7". The output signal from the lead cell is indicated by il'.

Figure 4:
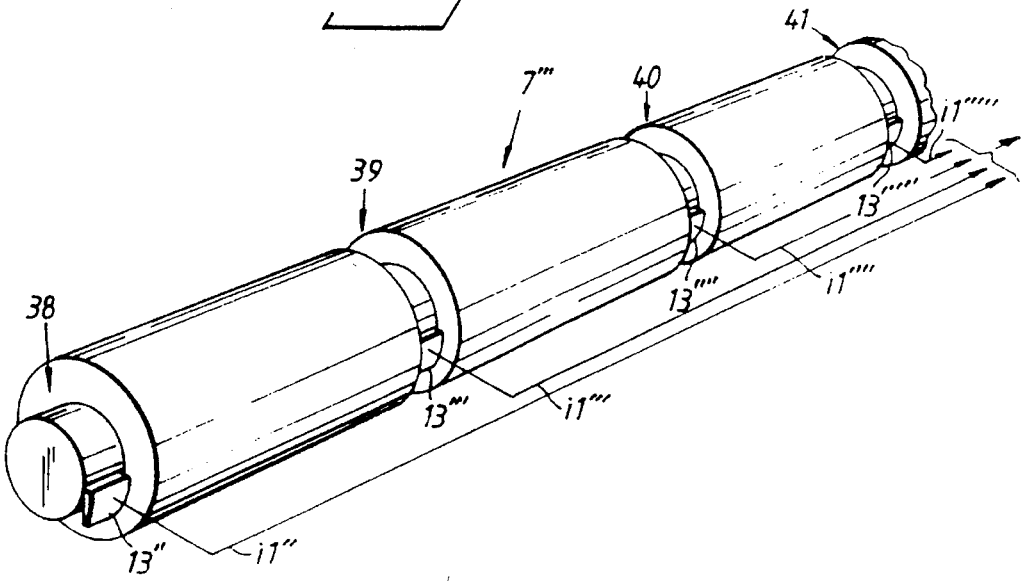
FIG. 4 shows, in perspective view, the mounting of a back rest, in which a load cell is arranged in each mounting point.

FIG. 4 shows the mounting of a beam 7'" corresponding to the beam 7" in FIG. 3. The mounting can be executed in a plurality of mounting points 38, 39, 40 and 41. One or more of the points can be provided with the force detection mechanism (cf. 13' in FIG. 3). In FIG. 4, each mounting point has been provided with its force detection mechanism 13', 13'"., 13"", 13"""", and the like. Each lead cell emits its signal il', il'"., il"", il"""", and the like.

In the power transmission between the rotating beam and the lead cell in question (13' in FIG. 3), which is fixedly arranged relative to the beam, use is preferably made of a power transmission mechanism 42 according to FIG. 3. The power transmission mechanism 42 can operate with a ball bearing function.

The invention is not limited to the embodiment shown by way of example above, but can be subject to modifications within the scope of subsequent patent claims and the inventive concept.

I claim:

1. A device for controlling warp thread tension in a weaving machine, the warp thread tension being dependent upon rotation of a plurality of beams forming part of the weaving machine and included in a back rest system for warp threads and wherein said plurality of beams are pressed against each other and the warp threads run between said beams, said device including:

means for suspending at least one beam of said plurality of beams in a positionally mobile manner, at least one force detection mechanism for detecting at least one force exerted on said at least one beam by the warp thread tension and for generating at least one control signal, and an activation system for providing said thread tension control, based on said at least one control signal, by affecting the rotations of the beams in both their rotational directions thereby adjusting the feed of the warp threads continuously or by close-intervalled step-by-step changes in forward and backwards directions.

2. A device according to claim 1, further comprising a drive source, which uses a feedback function and includes an alternating-current servo motor.

3. A device according to claim 2, wherein the beams' rotations in the back rest system are driven by said alternating-current servo motor via a gearbox and wherein said force detection mechanism includes a load cell which is arranged at a beam of the back rest system from which the warp threads run out.

4. A device according to claim 3, wherein said activation system includes a computer unit which receives and processes said at least one control signal and generates at least one target-value signal forwarded to said alternating-current servo motor, which includes a transmitter mechanism for generating an output signal which is fed back to the computer unit, which generates said at least one target-value signal based on said output signal.

5. A device according to claim 1, wherein said force detection mechanism produces said at least one control signal which is proportional to the detected force upon the beam resulting from the warp thread tension.

6. A device according to claim 1, wherein said means for suspending at least one beam of said plurality of beams in a positionally mobile manner suspend said one beam in at least two mounting points along its longitudinal extent and wherein said force detection mechanism includes a load cell provided in at least one of said mounting points.

7. A device according to claim 1, wherein each said force detection mechanism includes a load cell and bears against each rotating beam via a force transmission mechanism which transmits the detected force from the rotating beam to said load cell being fixedly arranged relative to the rotating beam.

8. A device according to claim 7, wherein the activation system includes means for programming said activation system to control at least one of movement and rotation of each beam, by comparing an actual value with a predetermined value.

9. A device according to claim 1, wherein the thread tension control is effectuated on a thread system, formed by warp and weft threads, having total fabric widths of up to b 10–30 meters and in which a weaving speed has values of up to about 100 picks per minute, and wherein the thread tensions in the warp threads is up to about 50,000 Newton/meter.

10. A device according to claim 1, further comprising means for activating said at least one beam by a force effectuated by the warp thread tension and a spring which endeavors to guide said at least one beam against said force.

11. A device according to claim 1, further comprising means for positionally displacing at least said beams of said back rest system, wherein said at least one force detection mechanism is fixed relative to said at least one beam.

* * * * *